US009814303B1

(12) United States Patent
Waitesmith

(10) Patent No.: US 9,814,303 B1
(45) Date of Patent: Nov. 14, 2017

(54) COSMETIC BRUSH CLEANING PAD

(71) Applicant: ARTIS LLC, Jersey City, NJ (US)

(72) Inventor: Matthew Waitesmith, Jersey City, NJ (US)

(73) Assignee: Artis LLC, Jersey City, NJ (US)

( * ) Notice: Subject to any disclaimer, the term of this patent is extended or adjusted under 35 U.S.C. 154(b) by 695 days.

(21) Appl. No.: 14/184,373

(22) Filed: Feb. 19, 2014

Related U.S. Application Data

(60) Provisional application No. 61/777,676, filed on Mar. 12, 2013.

(51) Int. Cl.

| | |
|---|---|
| ***A46B 17/06*** | (2006.01) |
| ***A47L 13/17*** | (2006.01) |
| *A47L 13/16* | (2006.01) |
| *B44D 3/00* | (2006.01) |
| *A47L 13/29* | (2006.01) |
| *A45D 33/00* | (2006.01) |

(52) U.S. Cl.
CPC ..... *A46B 17/06* (2013.01); *A46B 17/065* (2013.01); *A47L 13/17* (2013.01); *A45D 2033/001* (2013.01); *A47L 13/16* (2013.01); *A47L 13/29* (2013.01); *B44D 3/006* (2013.01)

(58) Field of Classification Search
CPC ..... A46B 17/06; B44D 3/006; A47L 23/22; A47L 23/266; A47L 13/16; A47L 13/17; A47L 13/28; A47L 13/29; A47L 13/42; A47L 13/44; A47L 21/00; A47L 21/06
USPC ..... 15/104.92–194.94, 423, 209.1, 210.1, 15/218, 218.1, 215–217, 220.4, 231, 15/257.01, 257.05; 132/286, 293, 294, 132/313, 317
See application file for complete search history.

(56) References Cited

U.S. PATENT DOCUMENTS

| | | | | | |
|---|---|---|---|---|---|
| 148,698 | A | * | 3/1874 | Higgins | A47L 13/29 15/231 |
| 487,446 | A | * | 12/1892 | Murphy | A47L 21/00 15/210.1 |
| 561,765 | A | * | 6/1896 | Cloud et al. | A47L 21/00 15/218.1 |
| 756,071 | A | * | 3/1904 | Smith | A45D 29/11 132/76.4 |
| 804,794 | A | * | 11/1905 | Coan | A47L 13/29 15/231 |

(Continued)

FOREIGN PATENT DOCUMENTS

GB 933629 * 8/1963

*Primary Examiner* — Mark Spisich
(74) *Attorney, Agent, or Firm* — Venable LLP; Steven J. Schwarz; Laura G. Remus

(57) ABSTRACT

A cosmetic brush cleaning pad for efficiently maintaining the cleanliness of makeup brushes while controlling microbial growth in the fiber bundle. The cosmetic brush cleaning pad generally includes a base housing and an upper platform adapted to be removably secured over the base housing. A cleaning member which is generally flexible woven fabric may be removably wrapped around the upper platform prior to it being secured to the base housing. The base housing may include an optional lid which is hingedly secured thereto and includes an access opening for allowing access to the cleaning member when the lid is closed. By assembling the present invention and dragging a cosmetic brush thereacross, the cleaning brush may be cleaned of cosmetics for further use.

16 Claims, 14 Drawing Sheets

(56) References Cited

U.S. PATENT DOCUMENTS

| | | | | | |
|---|---|---|---|---|---|
| 1,062,332 | A | * | 5/1913 | Harvey | A47L 13/16 118/269 |
| 1,118,546 | A | * | 11/1914 | Goodwin | A47L 13/29 15/231 |
| 1,416,619 | A | * | 5/1922 | Davis | A45D 29/11 132/76.5 |
| 2,084,292 | A | | 6/1937 | Steiner | |
| 2,088,650 | A | * | 8/1937 | Hartley | A47L 11/04 15/228 |
| 2,094,312 | A | | 9/1937 | Weisz | |
| 2,167,702 | A | | 8/1939 | Williamson | |
| 2,648,863 | A | * | 8/1953 | Darling | B43L 21/00 15/146 |
| 2,827,647 | A | | 3/1958 | Speer | |
| 3,750,224 | A | * | 8/1973 | Krusche | A46B 7/04 15/171 |
| 3,800,353 | A | * | 4/1974 | Roth | A46B 9/02 15/171 |
| 4,007,510 | A | * | 2/1977 | Scoggin, Jr. | A46B 7/04 15/176.1 |
| 5,122,195 | A | | 6/1992 | Hoffman | |
| 2003/0106568 | A1 | * | 6/2003 | Keck | A47L 13/16 134/6 |
| 2003/0200991 | A1 | * | 10/2003 | Keck | A47L 13/16 134/6 |
| 2011/0048443 | A1 | | 3/2011 | Pires | |
| 2012/0234346 | A1 | | 9/2012 | Kim | |

* cited by examiner

COSMETIC BRUSH CLEANING PAD

CROSS REFERENCE TO RELATED APPLICATIONS

I hereby claim benefit under Title 35, United States Code, Section 119(e) of U.S. provisional patent application Ser. No. 61/777,676 filed Mar. 12, 2013. The 61/777,676 application is hereby incorporated by reference into this application.

STATEMENT REGARDING FEDERALLY SPONSORED RESEARCH OR DEVELOPMENT

Not applicable to this application.

BACKGROUND OF THE INVENTION

Field of the Invention

The present invention relates generally to a cleaning device and more specifically it relates to a cosmetic brush cleaning pad for efficiently maintaining the cleanliness of makeup brushes while controlling microbial growth in the fiber bundle.

Description of the Related Art

Any discussion of the related art throughout the specification should in no way be considered as an admission that such related art is widely known or forms part of common general knowledge in the field.

Cosmetic brushes are utilized daily by millions of people throughout the world. The repeated, daily use of such brushes requires regular upkeep to maintain cleanliness of the brush and prevent potentially damaging growths, such as bacteria.

In the past, makeup brushes have been cleaned conventionally by wetting the brush bundle with water and then using a detergent-based product on the wet hairs to loosen makeup product debris therefrom. The bundle is then dragged back and forth across a paper towel or the like to further remove the debris. The bundle is then rinsed with more water to remove any remnants and the user squeezes as much of the remaining water from the bundle as possible. The user will then often shape the moist bundle into an approximation of the original shape and then place in an open air environment to allow to dry.

While this conventional prior art method of cleaning brushes is common, it does suffer from a number of drawbacks. First, the detergent-based formula used in connection with water may be effective at removing excess debris from the hair bundle, but it can also cause structural damage to the bundle shaft due to the chemical solvent nature of the water and detergent on the proteins and amino acids that make up the animal and human hair shafts so commonly used in makeup brushes. The water and detergent may also act to accelerate degradation of the amino acid bonds which hold the protein structure together to form the hair shaft. Additionally, the effect of excess moisture on the hair shaft may cause the protein structure to swell and contract with each cleaning and drying cycle. Further, usage of water and detergency does not itself provide any substantial abeyance of microbial presence on the hair. Finally, the long cleaning cycle of this prior art method requires a professional to stock multiples of each makeup brush to keep up with demand without risking customers to exposure to a dirty brush.

Because of the inherent problems with the related art, there is a need for a new and improved cosmetic brush cleaning pad for efficiently maintaining cleanliness of makeup brushes while controlling microbial growth in the fiber bundle.

BRIEF SUMMARY OF THE INVENTION

The invention generally relates to a cleaning pad which includes a base housing and an upper platform adapted to be removably secured over the base housing. A cleaning member which is generally flexible woven fabric may be removably wrapped around the upper platform prior to it being secured to the base housing. The base housing may include an optional lid which is hingedly secured thereto and includes an access opening for allowing access to the cleaning member when the lid is closed. By assembling the present invention and dragging a cosmetic brush thereacross, the cleaning brush may be cleaned of cosmetics for further use.

There has thus been outlined, rather broadly, some of the features of the invention in order that the detailed description thereof may be better understood, and in order that the present contribution to the art may be better appreciated. There are additional features of the invention that will be described hereinafter and that will form the subject matter of the claims appended hereto. In this respect, before explaining at least one embodiment of the invention in detail, it is to be understood that the invention is not limited in its application to the details of construction or to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE INVENTION

A. Overview

Figure 1:
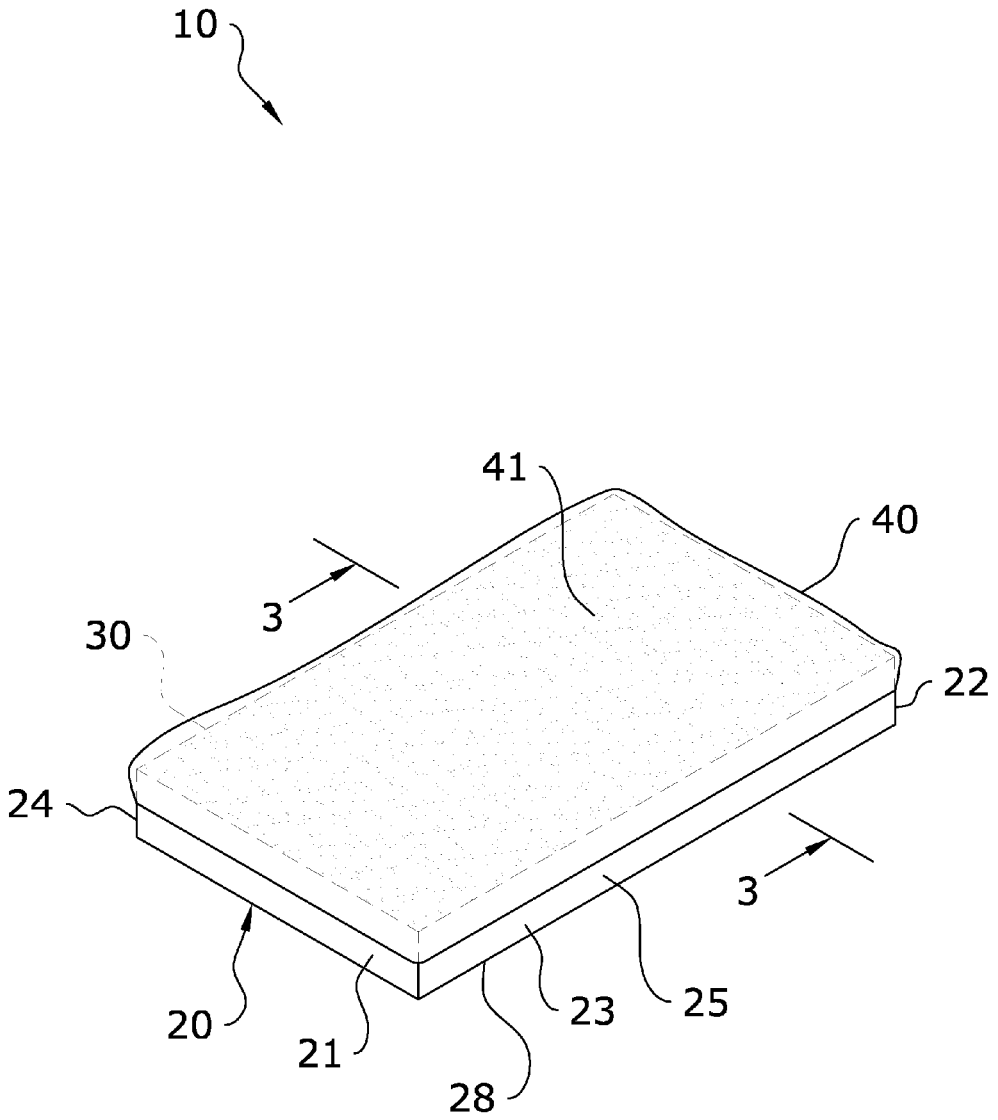
FIG. 1 is an upper perspective view of the present invention.

Turning now descriptively to the drawings, in which similar reference characters denote similar elements throughout the several views, FIGS. 1 through 10 illustrate a cosmetic brush cleaning pad 10, which comprises a base housing 20 and an upper platform 30 adapted to be removably secured over the base housing 20. A cleaning member 40 which is generally flexible woven fabric may be removably wrapped around the upper platform 30 prior to it being secured to the base housing 20. The base housing 20 may include an optional lid 50 which is hingedly secured thereto and includes an access opening 52 for allowing access to the cleaning member 40 when the lid 50 is closed. By assembling the present invention and dragging a cosmetic brush 12 thereacross, the cleaning brush 12 may be cleaned of cosmetics for further use.

B. Base Housing

Figure 2:
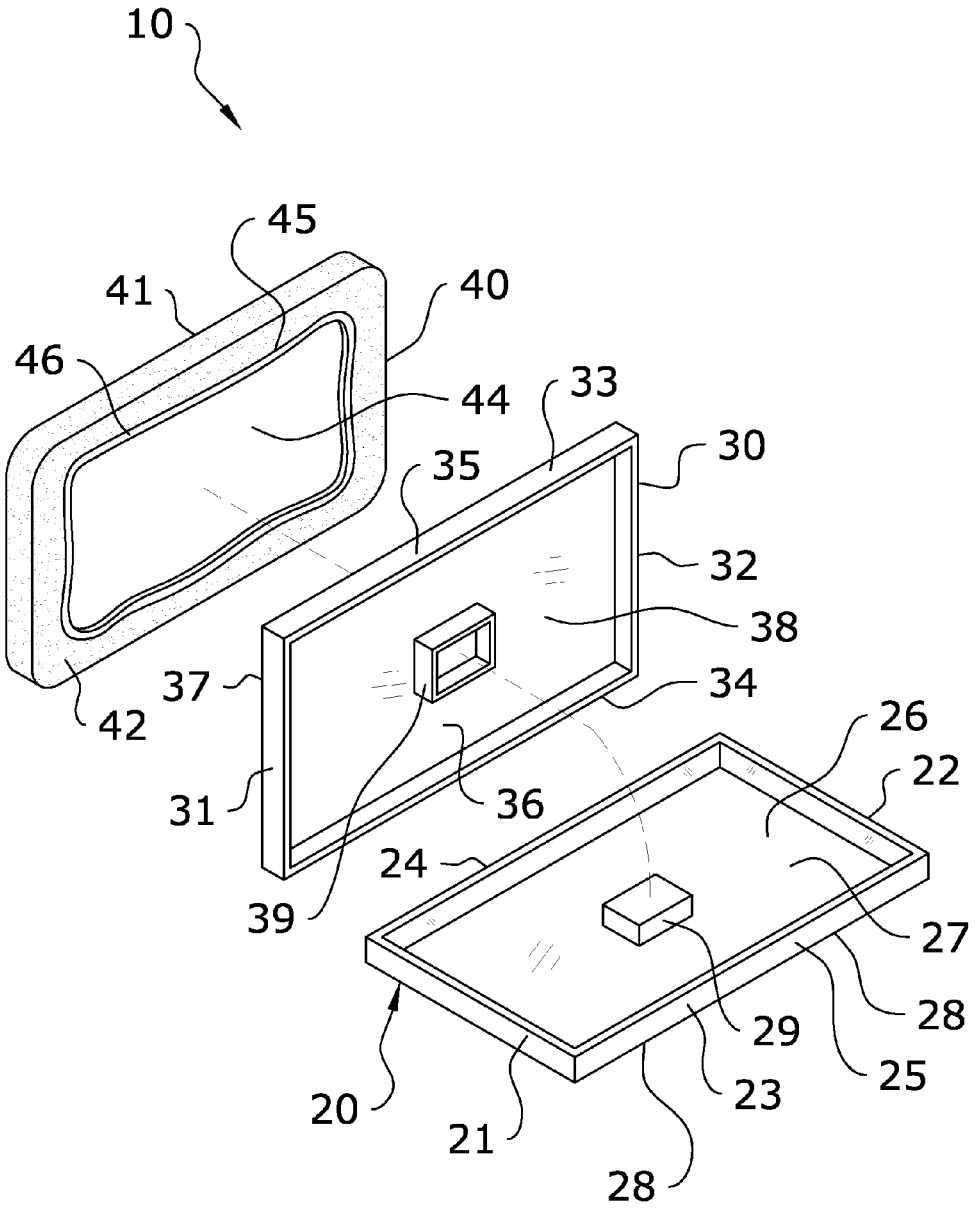
FIG. 2 is an upper perspective view of the present invention in a disassembled state.
Figure 6:
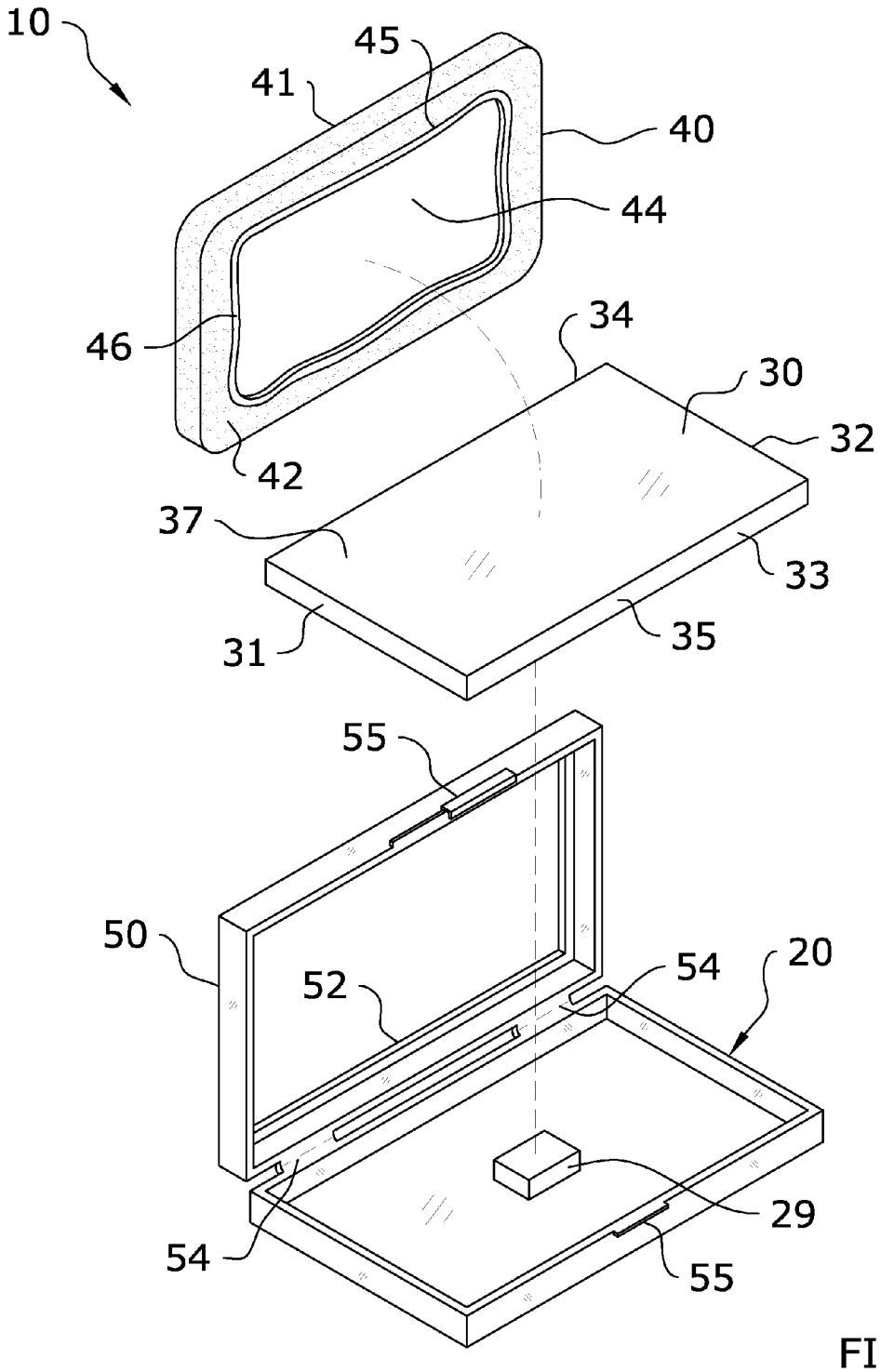
FIG. 6 is a first upper perspective view of the alternate embodiment of the present invention in a disassembled state.
Figure 7:
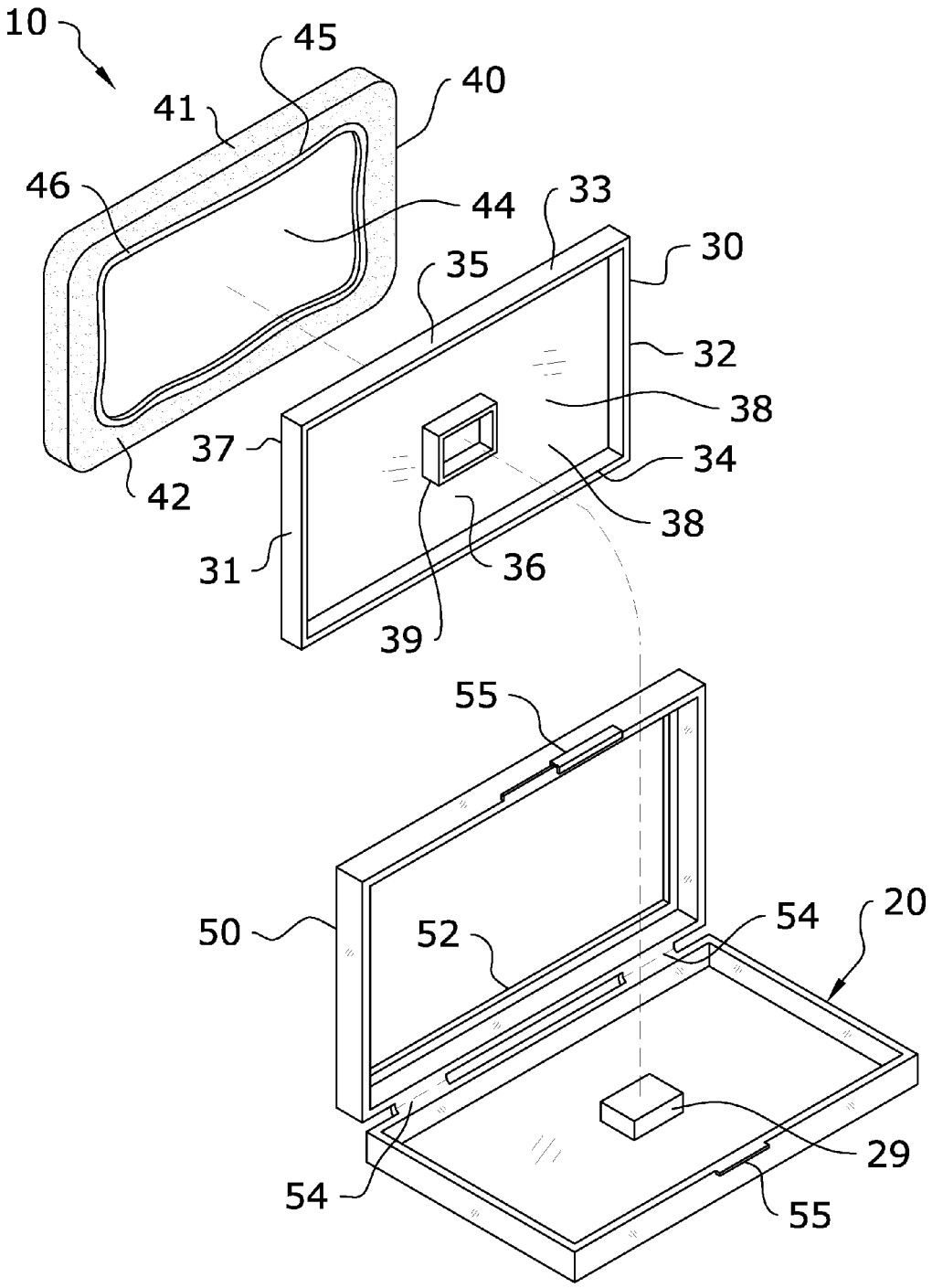
FIG. 7 is a second upper perspective view of the alternate embodiment of the present invention in a disassembled state.
Figure 8:
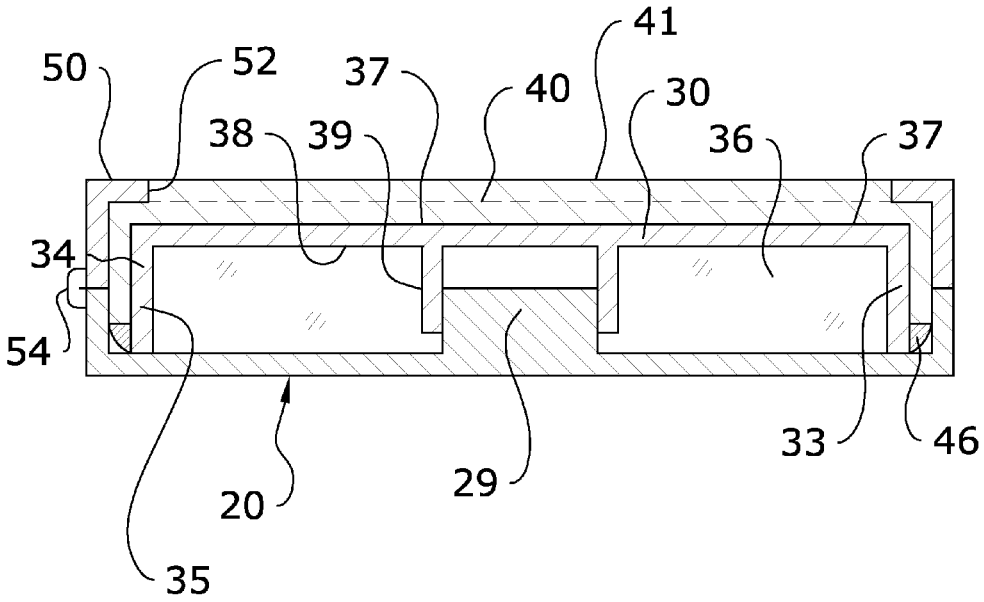
FIG. 8 is a side sectional view of the alternate embodiment of the present invention.

As best shown in FIGS. 2, 6, and 7, the present invention includes a base housing 20 to which the upper platform 30 of the present invention may be removably secured. The base housing 20 aids in concealing the bottom portion of the cleaning member 40 to improve the overall aesthetics of the present invention.

The configuration, shape, and size of the base housing 20 may vary for different embodiments. Thus, the scope of the present invention should not be construed as being limited by the exemplary figures. In a preferred embodiment, the base housing 20 is comprised of a substantially rectangular configuration as shown in the figures which includes a first side 21, a second side 22, a front edge 23, and a rear edge 24.

As best shown in FIG. 2, the base housing 20 includes an outer lip 25 which extends upwardly from the upper surface 27 of the base housing 20 around the base housing's 20 outer edge. The outer lip 25 acts to define an upper recess 26 which is formed in the base housing 20. In some embodiments, the outer lip 25 may be omitted so long as the upper platform 30 may be securely but removably secured to the base housing 20 as described herein.

Figure 3:
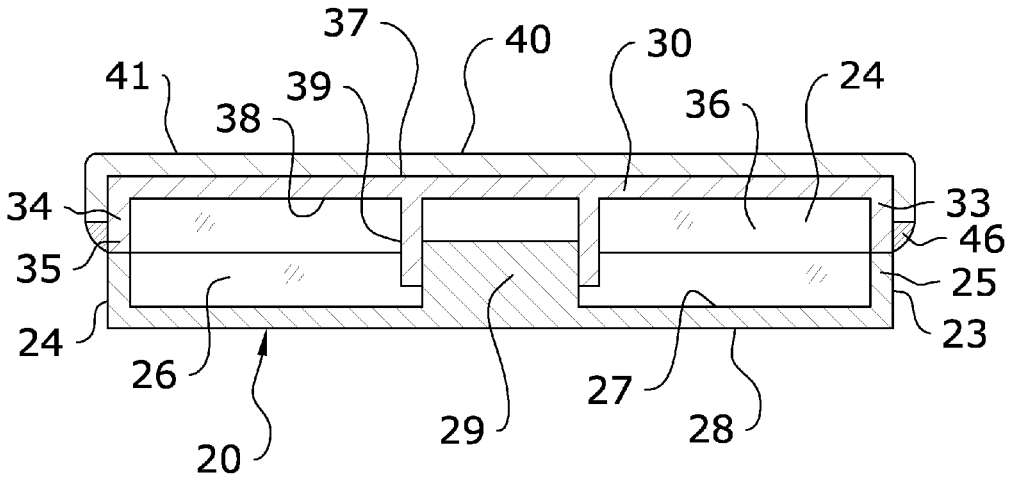
FIG. 3 is a side sectional view of the present invention.

The upper surface 27 of the base housing 20 within the upper recess 26 will generally include a first linkage 29. The first linkage 29 is utilized to engage with the second linkage 39 of the upper platform 30 to removably secure the upper platform 30 to the base housing 20, such as shown in FIG. 3. The first linkage 29 may be located at any position along the upper surface 27 of the base housing 20 so long as it is aligned with the corresponding location of the second linkage 39 on the lower surface 38 of the upper platform 30.

The first linkage 29 will be adapted to secure the base housing 20 and upper platform 30 together in combination with the second linkage 39. Multiple configurations may be utilized and the scope of the present invention should not be construed as limited by the exemplary configurations shown in the figures. In one embodiment as shown, the linkages 29, 39 are comprised of male/female connectors which frictionally engage with each other to secure the base housing 20 and upper platform 30 to each other.

The lower surface 28 of the base housing 20 will generally rest on a surface when the present invention is in use. The lower surface 28 of the base housing 20 may include a non-slip coating to aid in stabilizing the base housing 20 on smooth surfaces such as a bathroom vanity or table top.

C. Upper Platform

As best shown in FIGS. 2, 6, and 7, the present invention includes an upper platform 30 which is removably secured over the base housing 20. The cleaning member 40 of the present invention is removably positioned around an upper surface 37 of the upper platform 30 to aid in cleaning a cosmetic brush 12 or other similar tool.

The configuration, shape, and size of the upper platform 30 may vary for different embodiments. Thus, the scope of the present invention should not be construed as being limited by the exemplary figures. In a preferred embodiment, the upper platform 30 is comprised of a substantially rectangular configuration as shown in the figures which includes a first side 31, a second side 32, a front edge 33, and a rear edge 34. The outer edge size of the upper platform 30 will preferably be slightly smaller or slightly larger than that of the base housing 20 so that the base housing 20 and upper platform 30 may be connected to each other as shown in the figures.

As best shown in FIG. 2, the upper platform 30 includes an outer lip 35 which extends downwardly from the lower surface 38 of the upper platform 30 around the upper platform's 30 outer edge. The outer lip 35 acts to define an lower recess 36 which is formed in the upper platform 30. In some embodiments, the outer lip 35 may be omitted so long as the upper platform 30 may be securely but removably secured to the base housing 20 as described herein.

The lower surface 38 of the upper platform 30 within the lower recess 36 will generally include a second linkage 39. The second linkage 39 is utilized to engage with the first linkage 29 of the base housing 20 to removably secure the upper platform 30 to the base housing 20, such as shown in FIG. 3. The second linkage 39 may be located at any position along the lower surface 38 of the upper platform 30 so long as it is aligned with the corresponding location of the first linkage 29 on the upper surface 27 of the base housing 20.

D. Cleaning Member

As best shown in FIGS. 2, 6, 7, the present invention includes a cleaning member 40 which is removably secured around the upper platform 30 prior to it being connected to the base housing 20 to form the present invention. The cleaning member 40 may be comprised of various materials, structures, and configurations, and thus should not be construed as being limited by the exemplary figures.

The cleaning member 40 is preferably comprised of a microfiber cloth which has been treated with an antimicrobial treatment to inhibit growth of microbes. The cleaning member 40 may be dry or pre-wettened. This treated surface minimizes any cross-contamination effects while aiding in removing and inhibiting microbial presence on the hair shafts of the cosmetic brush 12 bundle.

The cleaning member 40 is preferably sewn into a shape which allows it to stretch over the preferably rigid upper platform 30 as shown in the figures. The cleaning member 40 will generally include an upper end 41 which is utilized to clean the cosmetic brush 12. The cleaning member 40 is preferably woven using synthetic fibers which do not inherently provide a suitable platform for microbial growth.

The weave pattern utilized with the cleaning member 40 creates hundreds of thousands of fiber loops which act to gently work against the sides of hair shafts of a cosmetic brush 12 to help loosen and grab makeup debris therefrom. This action is less damaging to the hair shaft than the action of rubbing a wet bundle across a wood pulp product such as a paper towel.

Figure 9:
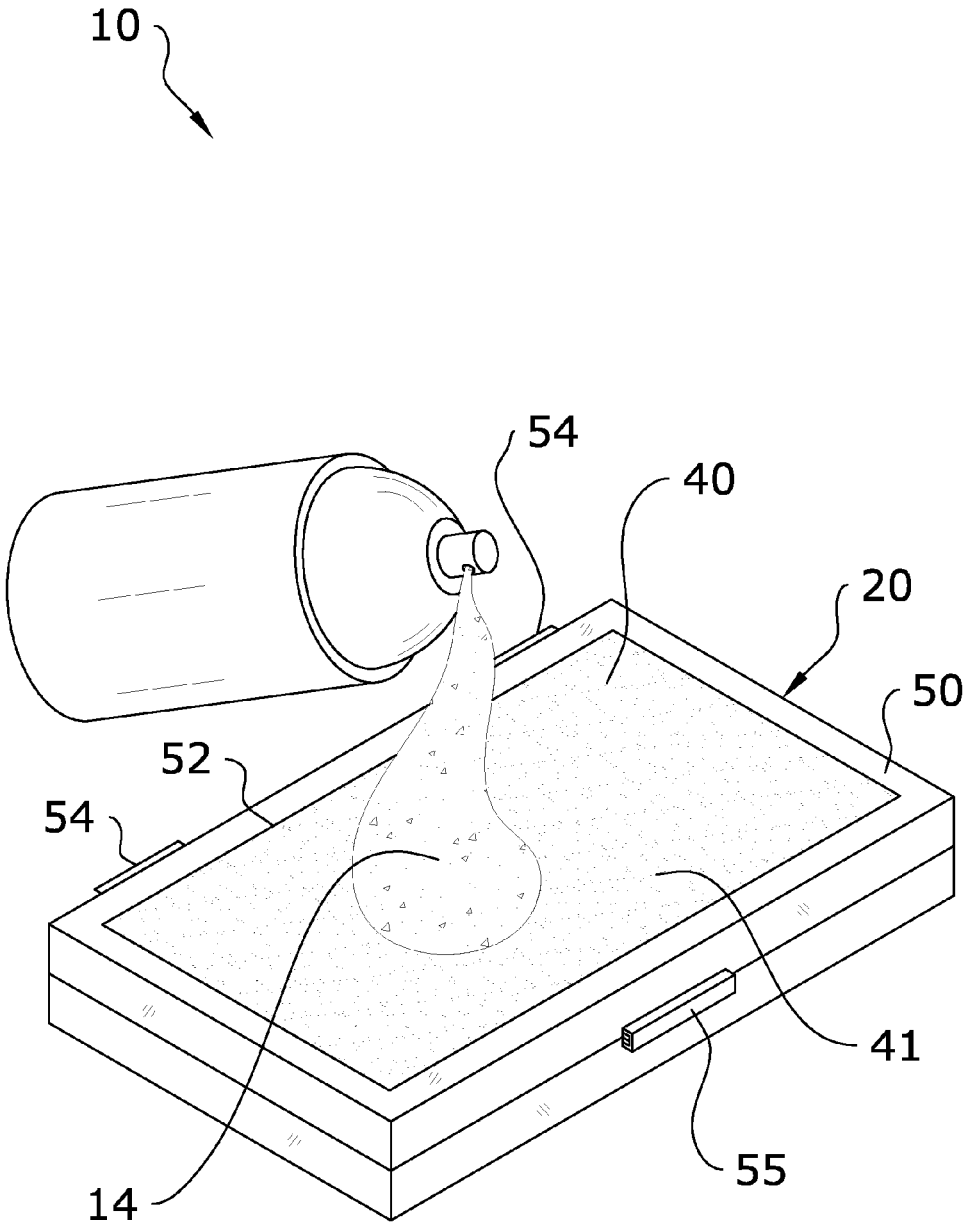
FIG. 9 is an upper perspective view illustrating a cleaning solution being applied to the present invention.

In some embodiments, the upper end 41 of the cleaning member 40 may be treated with a cleaning solution 14 as shown in FIG. 9. The cleaning solution 14 may be added to the cleaning member 40 to increase its cleaning and anti-microbial effects on the cosmetic brush 12.

The cleaning solution 14 may be comprised of various solutions or compositions known to clean a material. In a preferred embodiment, the cleaning solution 14 may be comprised of a liquid formula containing water, sanitizing ingredients, surfactants and fragrance which is adapted to be dispensed as a foam. This foam coats the hair shafts and helps loosen debris without over-soaking the hair shafts. The foam bubbles effectively remove makeup debris without penetrating deeply inside the hair shaft. This allows for a shorter dry time to allow for quicker re-use in a professional setting. The foam is held more securely in place by the structure of the microfiber cleaning member 40 so that when the hair bundle is stroked thereacross, the cleaning action is enhanced.

The lower end 42 of the cleaning member 40 includes a central opening 44 through which the cleaning member 40 is positioned around the upper platform 30. The inner circumference 45 of the central opening 44 may include an elastic member 46 to aid in retaining the cleaning member 40 around the upper platform 30. This configuration holds the cleaning member 40 tightly in place when a cosmetic brush 12 hair bundle is being moved across the surface of the cleaning member 40 for cleaning.

E. Lid

Figure 4:
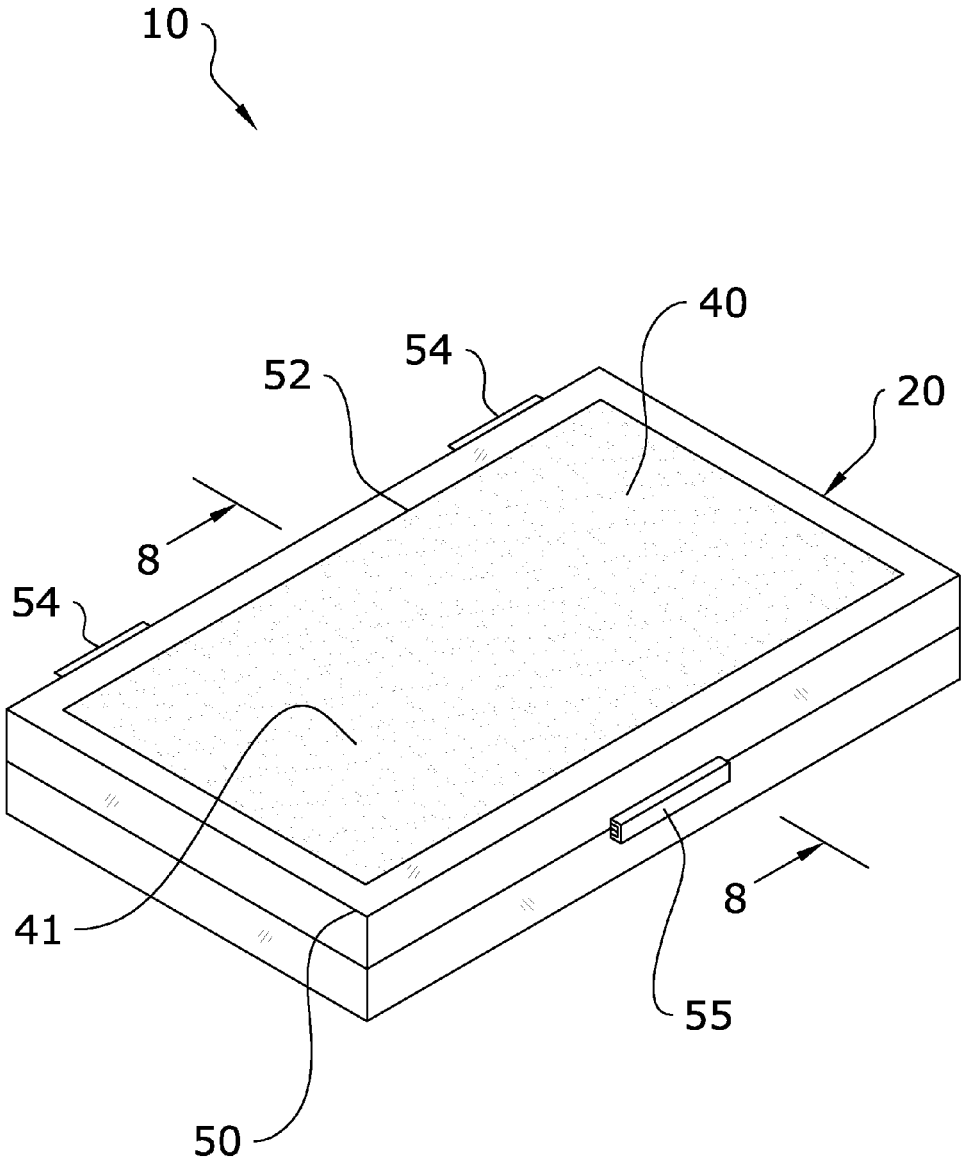
FIG. 4 is an upper perspective view of an alternate embodiment of the present invention which includes a lid.
Figure 5:
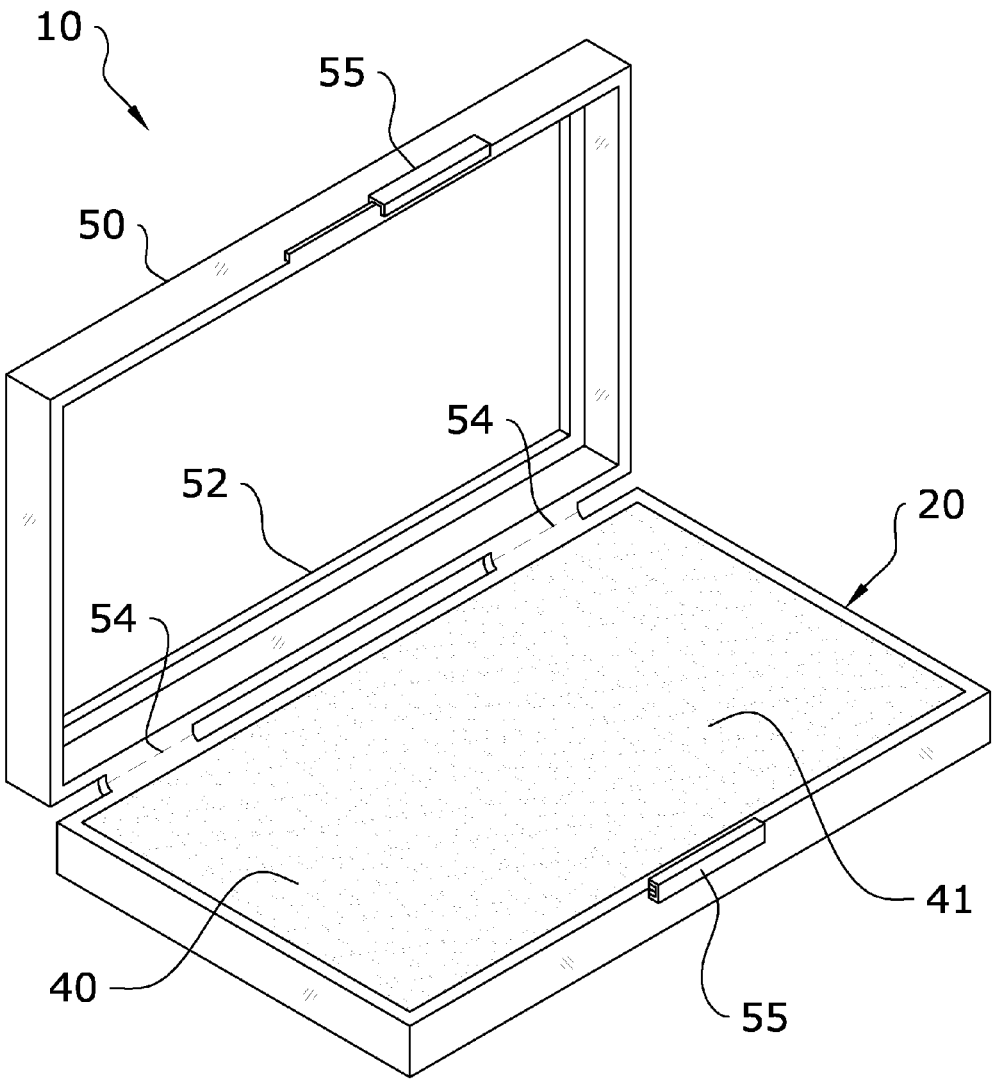
FIG. 5 is an upper perspective view of the alternate embodiment of the present invention in an opened state.

As shown in FIGS. 4-10, some embodiments of the present invention may include a lid 50 which aids in securing the cleaning member 40 in place and adds to the aesthetics of the present invention. The lid 50 is generally secured to the base housing 20 in a hinged manner to allow the lid 50 to be opened as shown in FIG. 5 or closed as shown in FIG. 4.

The lid 50 generally comprises a rectangular frame with an access opening 52 such as the window shown in the figures. The access opening 52 allows access to the cleaning member 40 when the lid 50 is closed. The size and configuration of the access opening 52 may vary and should not be construed as limited by the exemplary figures.

The lid 50 will generally be hingedly connected to the base housing 20 via one or more hinges 54. In a preferred embodiment, the hinges 54 will be positioned along the rear edge 24 of the base housing 20 between its first and second sides 21, 22 as shown in the figures. Various types and configurations of hinges 54 or other connectors may be utilized so long as the lid 50 is adapted to open and close over the upper platform 30 when it rests within the base housing 20.

The lid 50 may also include a locking mechanism 55 to secure the lid 50 in its closed position. The figures illustrate clasps/brackets positioned on the front edge 23 of the base housing 20 and the lid 50 so that the lid 50 may be removably secured in a closed state with the base housing 20. Various other locking mechanisms 55 may be utilized.

F. Operation of Preferred Embodiment

In use, the upper platform 30 is first removed from the base housing 20. The cleaning member 40 may then be wrapped around the upper surface 37 of the upper platform 30 by positioning the upper platform 30 through the central opening 44 of the cleaning member 40 and allowing the cleaning member 40 to wrap around the outer lip 35 of the upper platform 30.

With the cleaning member 40 positioned around the upper platform 30, the upper platform 30 may be connected to the base housing 20. The linkages 29, 39 are aligned and the upper platform 30 is lowered onto the base housing 20 such that the linkages 29, 39 frictionally engage to secure the upper platform 30 and base housing 20 together. If a lid 50 is included, the lid 50 may be closed so that the upper end 41 of the cleaning member 40 is accessible through the access opening 52 of the lid 50.

Figure 10:
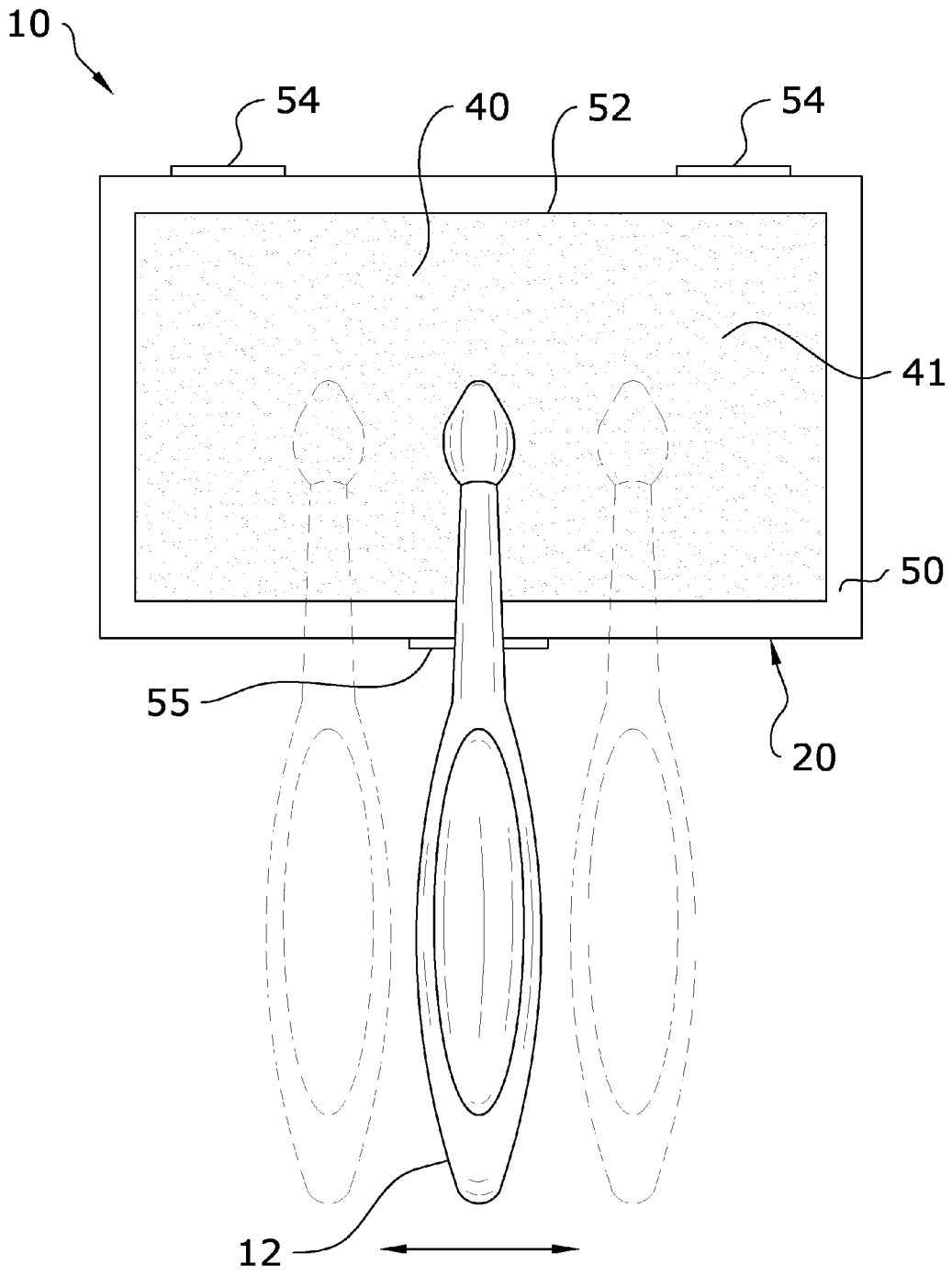
FIG. 10 is a top view illustrating usage of the present invention to clean a cosmetic brush.

If desired, a cleaning solution 14 may be applied to the cleaning member 40 as shown in FIG. 9. The cosmetic brush 12 may then be dragged across the cleaning member 40 to clean any bristle hairs as shown in FIG. 10. When completed, the cleaning member 40 may be removed to be disposed of or cleaned for further use.

FIGS. 11 through 14 illustrate exemplary embodiments of the brush cloth platform 1000 of the present invention. It is appreciated that the overall construction, such as the shape, size and design, of the present invention may vary in different embodiments. The figures are merely for exemplary purposes only and one of ordinary skill in the art will appreciate that the scope of the present invention should not be construed as being limited by these exemplary figures.

Figure 11:
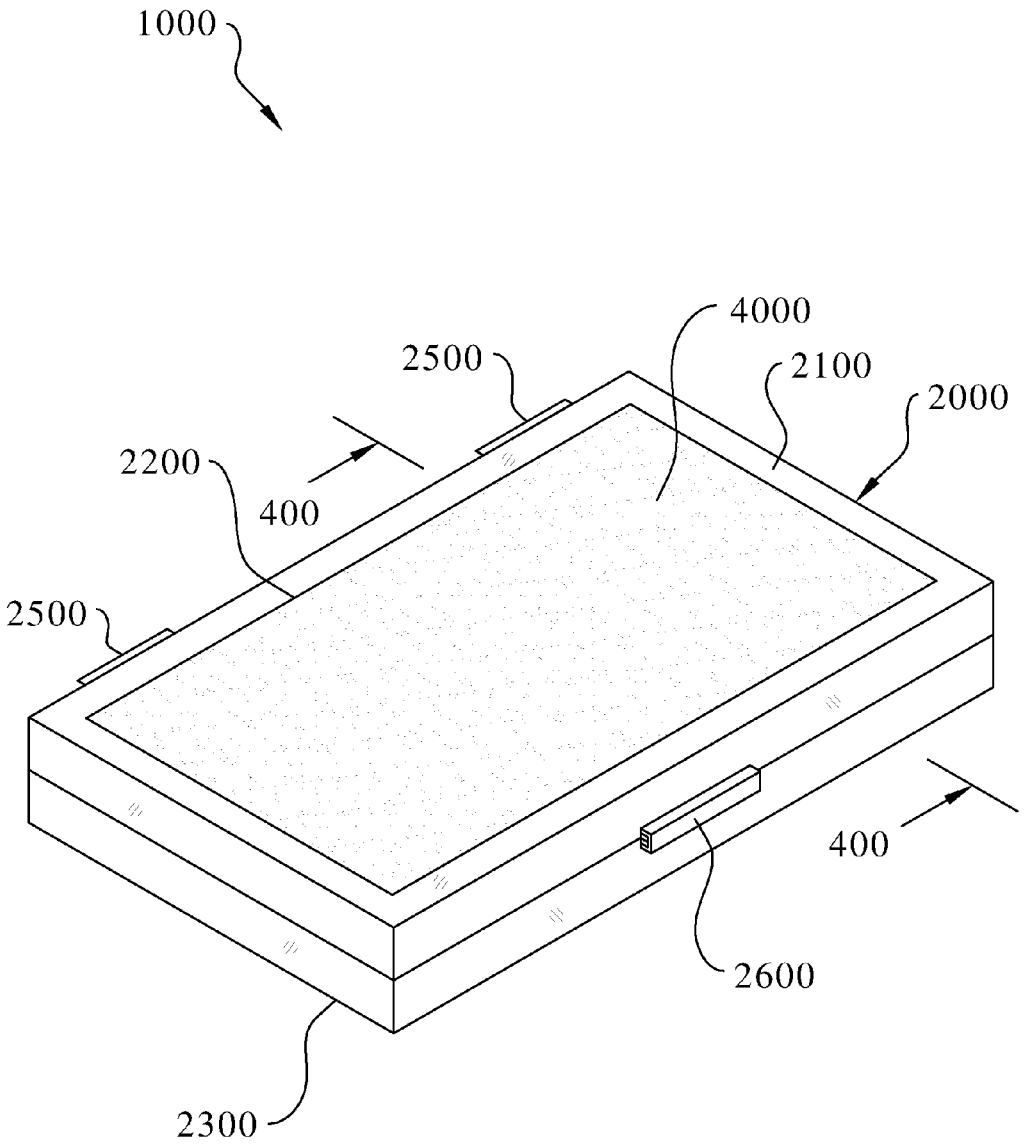
FIG. 11 is an upper perspective view of an embodiment of the present invention in a closed state.
Figure 12:
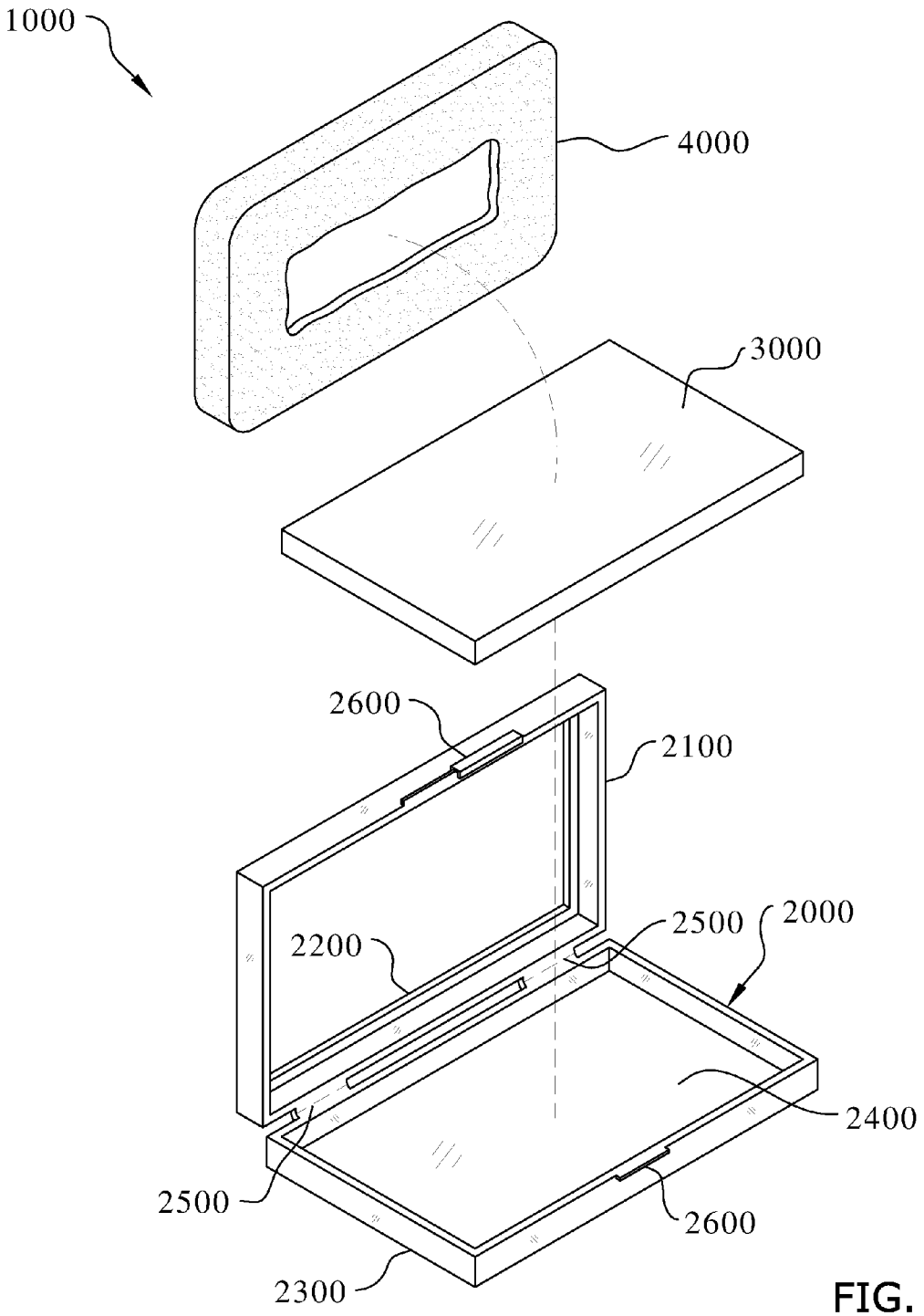
FIG. 12 is an upper perspective view of an embodiment of the present invention in an opened state.
Figure 13:
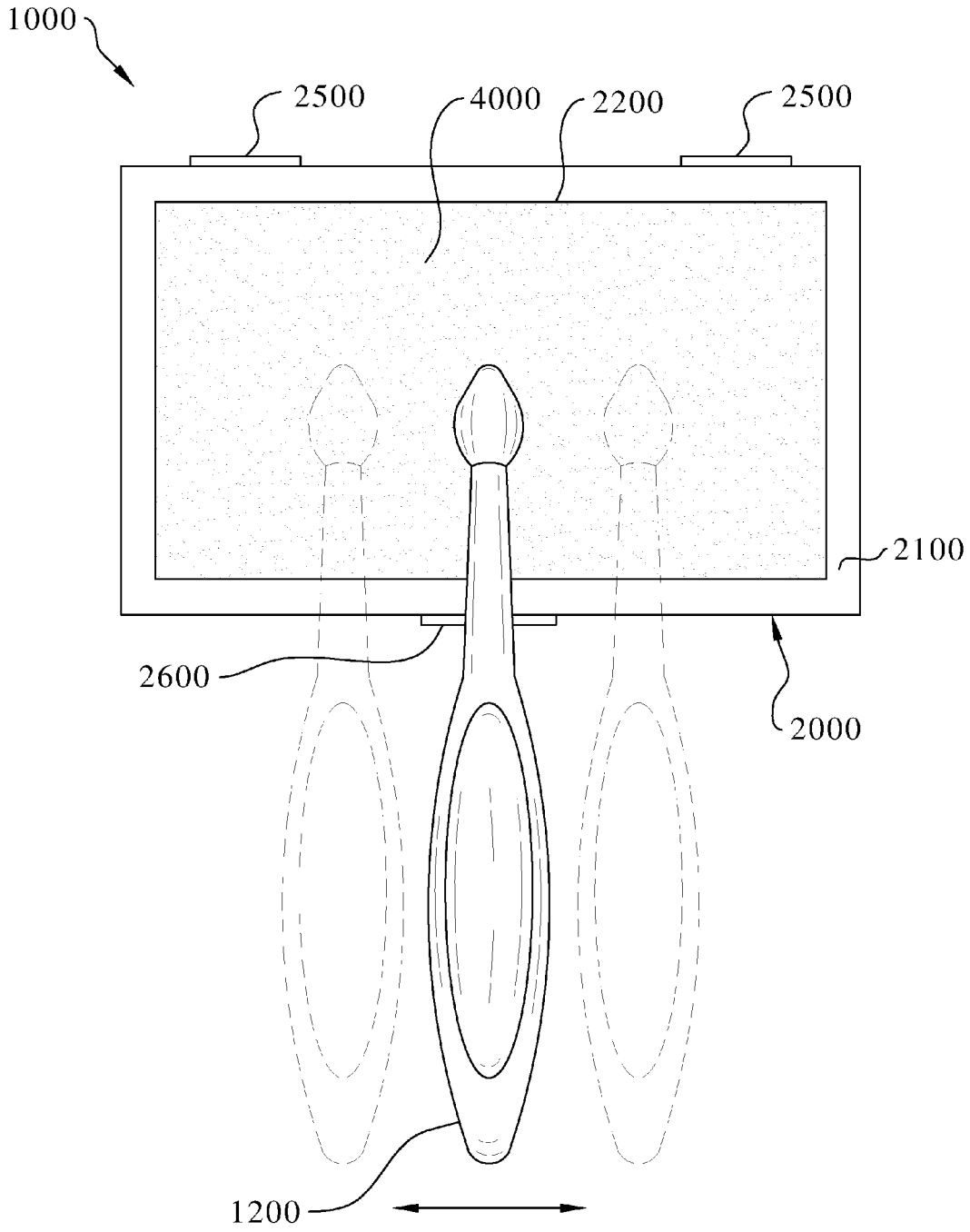
FIG. 13 is a top view of an embodiment of the present invention in use.
Figure 14:
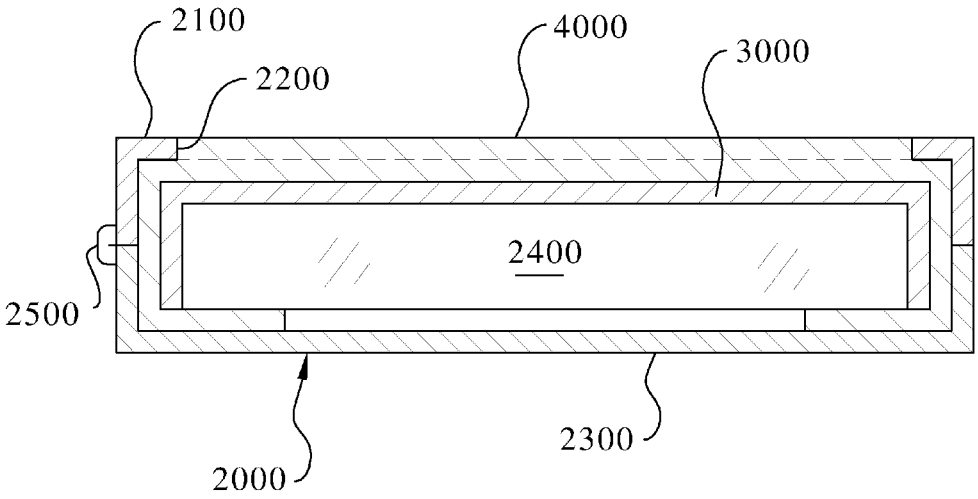
FIG. 14 is a side sectional view taken along line 400-400 of FIG. 11.

In one embodiment shown in FIGS. 11 and 12, the present invention is comprised of a housing 2000 adapted to store a cloth platform 3000 wrapped in a cloth wrap 4000. The structure of the housing 2000 may vary significantly so long as access is provided to the cloth wrap 4000. In a preferred embodiment, the housing 2000 includes a lid 2100 and a base 2300, wherein the lid is hingedly secured to the base 2300 via one or more hinges 2500.

The lid 2100 includes a window 2200 extending therethrough which provides access to the cloth platform 3000 and cloth wrap 4000 which are positioned within the base 2300. The base 2300 includes a cavity 2400 in which the cloth platform 3000 and cloth wrap 4000 are positioned. The lid 2100 and base 2300 each include locking mechanisms 2600 with which the lid 2100 may be selectively secured to the base 2300 to close the present invention.

The base 2300 of the housing 2000 hides the bottom section of the cloth wrap 4000 to improve overall aesthetics of the present invention. The bottom surface of the base 2300 may include a non-slip coating to aid in stabilizing the housing 2000 on smooth surfaces such as a bathroom vanity or table top. The size and shape of the housing 2000 makes it easy to position on a work surface or carry in a bag with other makeup tools.

Stored within the cavity 2400 of the base 2300 is a cloth platform 3000 around which is secured a cloth wrap 4000. The cloth platform 3000 is preferably comprised of a substantially rectangular, rigid base around which the cloth wrap 4000 will be secured. The cloth platform 3000 acts as a base securing point for the cloth wrap 4000 and also acts to give shape to the cloth wrap 4000 for usage.

The cloth wrap 4000 is preferably comprised of a microfiber cloth which has been treated with an antimicrobial treatment to inhibit growth of microbes. The cloth wrap 4000 may be dry or pre-wettened. This treated surface minimizes any cross-contamination effects while aiding in removing and inhibiting microbial presence on the hair shafts of the makeup brush 1200 bundle.

The cloth wrap 4000 is preferably woven using synthetic fibers which do not inherently provide a suitable platform for microbial growth. The weave pattern utilized with the cloth wrap 4000 creates hundreds of thousands of fiber loops which act to gently work against the sides of hair shafts of a brush 1200 to help loosen and grab makeup debris therefrom. This action is less damaging to the hair shaft than the action of rubbing a wet bundle across a wood pulp product such as a paper towel.

The cloth wrap 4000 is preferably sewn into a shape which allows it to stretch over the preferably rigid cloth platform 3000 as shown in the figures. This configuration holds the cloth wrap 4000 tightly in place when a makeup brush 1200 hair bundle is being moved across the surface of the cloth wrap 4000 for cleaning.

The cloth wrap 4000 is preferably fully removable and adapted to be conventionally laundered without degradation. In some embodiments, the cloth wrap 4000 may be disposable.

In use, the housing 2000 is opened and the cloth wrap 4000 extended around the cloth platform 3000. The housing 2000 may then be closed, with the cloth wrap's 4000 upper surface being exposed through the window 2200 of the lid 2100. A makeup brush 1200 may have its hair bundle dragged across the cloth wrap 4000 through the window 2200 to clean the bundle of the brush 1200.

Optionally, a cleaning foam may be added to the cloth wrap 4000 to increase its cleaning and antimicrobial effects on the brush 1200. The cleaning foam may be comprised of a liquid formula containing water, sanitizing ingredients, surfactants and fragrance which is adapted to be dispensed as a foam. This foam coats the hair shafts and helps loosen debris without oversoaking the hair shafts. The foam bubbles effectively remove makeup debris without penetrating deeply inside the hair shaft. This allows for a shorter dry time to allow for quicker re-use in a professional setting. The foam is held more securely in place by the structure of the microfiber cloth wrap 4000 so that when the hair bundle is stroked thereacross, the cleaning action is enhanced.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. The present invention may be embodied in other specific forms without departing from the spirit or essential attributes thereof, and it is therefore desired that the present embodiment be considered in all respects as illustrative and not restrictive. Any headings utilized within the description are for convenience only and have no legal or limiting effect.

The invention claimed is:

1. A brush cleaning pad, comprising:

a base housing;

an upper platform removably secured to said base housing; and a cleaning member removably wrapped around said upper platform, said cleaning member being adapted to clean bristles of a cosmetic brush, wherein said base housing includes an outer lip defining an upper recess, wherein said upper platform includes an outer lip defining a lower recess, and wherein said base housing includes a lid, wherein said lid includes an access opening and is hingedly secured to said base housing.

2. The brush cleaning pad of claim 1, wherein said cleaning member is comprised of a microfiber cloth.

3. The brush cleaning pad of claim 2, wherein said cleaning member is treated with an antimicrobial treatment.

4. The brush cleaning pad of claim 3, further comprising a cleaning solution applied to said cleaning member.

5. The brush cleaning pad of claim 2, wherein said microfiber cloth comprises synthetic fibers.

6. The brush cleaning pad of claim 1, further comprising a first linkage positioned within said upper recess of said base housing.

7. The brush cleaning pad of claim 6, further comprising a second linkage positioned within said lower recess of said upper platform, said first linkage and said second linkage being adapted to frictionally engage with each other to removably secure said base housing and said upper platform.

8. A brush cleaning pad, comprising:

a base housing including a first outer lip defining an upper recess;

an upper platform removably secured to said base housing, wherein said upper platform includes a second outer lip defining a lower recess;

at least one linkage for removably connecting said upper platform to said base housing; and a cleaning member removably wrapped around said upper platform, said cleaning member being adapted to clean bristles of a cosmetic brush, wherein said base housing includes a hinged lid, wherein said lid includes a window to provide access to said cleaning member.

9. The brush cleaning pad of claim 8, wherein said cleaning member is comprised of a microfiber cloth.

10. The brush cleaning pad of claim 9, wherein said cleaning member is treated with an antimicrobial treatment.

11. The brush cleaning pad of claim 10, further comprising a cleaning solution applied to said cleaning member.

12. The brush cleaning pad of claim 9, wherein said microfiber cloth comprises synthetic fibers.

13. The brush cleaning pad of claim 8, wherein said at least one linkage comprises a first linkage positioned within said upper recess of said base housing.

14. The brush cleaning pad of claim 13, further comprising a second linkage positioned within said lower recess of said upper platform, said first linkage and said second linkage being adapted to frictionally engage with each other.

15. A method of cleaning a cosmetic brush, comprising:

providing a brush cleaning pad, said brush cleaning pad comprising a base housing and an upper platform removably secured to said base housing, wherein said base housing includes an outer lip defining an upper recess and a hinged lid having an access opening, and wherein said upper platform includes an outer lip defining a lower recess;

removably securing a cleaning member around said upper platform, wherein said cleaning member is comprised of a microfiber cloth treated with an antimicrobial treatment;

opening said hinged lid of said base housing;

positioning said upper platform over said base housing to removably connect said upper platform with said base housing;

closing said hinged lid of said base housing over said upper platform and said cleaning member;

applying a cleaning solution to said cleaning member; and dragging a cosmetic brush across said cleaning member to clean one or more bristle hairs of said cosmetic brush.

16. The method of cleaning a cosmetic brush of claim 15, wherein said cleaning solution is comprised of a cleaning foam.

* * * * *